United States Patent [19]

Ferry

[11] 3,961,385

[45] June 8, 1976

[54] PLACEMENT FOR BEDSPREAD

[75] Inventor: Rose M. Ferry, Tracy, Calif.

[73] Assignee: The Raymond Lee Organization, Inc., New York, N.Y. ; a part interest

[22] Filed: Sept. 10, 1974

[21] Appl. No.: 504,753

[52] U.S. Cl. ..... 5/318
[51] Int. Cl.[2] ..... A47C 21/00
[58] Field of Search ..... 5/318, 319

[56] References Cited

UNITED STATES PATENTS 2,976,546 3/1961 Owens ..... 5/318

FOREIGN PATENTS OR APPLICATIONS 27,135 6/1911 United Kingdom ..... 5/318

*Primary Examiner*—Robert L. Wolfe
*Assistant Examiner*—Andrew M. Calvert
*Attorney, Agent, or Firm*—Howard I. Podell

[57] ABSTRACT

A reclining platform hingeably mountable to the end of a mattress of a bed for the storing of a bedspread or blankets of the bed, when desired. The platform is hinged mounted to a support frame that clamps to the end of the mattress, with the frame supported by braces which fit between the mattress and the mattress spring. The table folds into the vertical plane, when not in use and may be covered by the bedspread, when the bed is made up.

1 Claim, 2 Drawing Figures

PLACEMENT FOR BEDSPREAD

SUMMARY OF THE INVENTION

My invention relates to a reclining platform hingeably mounted to the end of a mattress of a bed for the storing of a bedspread or blankets of the bed.

Folding legs are attached to the underside of the platform to maintain the platform in a generally reclining horizontal plane, when the bed is in use, for storage of the bedspread and excess blankets.

BRIEF DESCRIPTION OF THE DRAWING

The objects and features of the invention may be understood with reference to the following detailed description of an illustrative embodiment of the invention, taken together with the accompanying drawings in which.

DESCRIPTION OF THE PREFERRED EMBODIMENT

Figure 1:
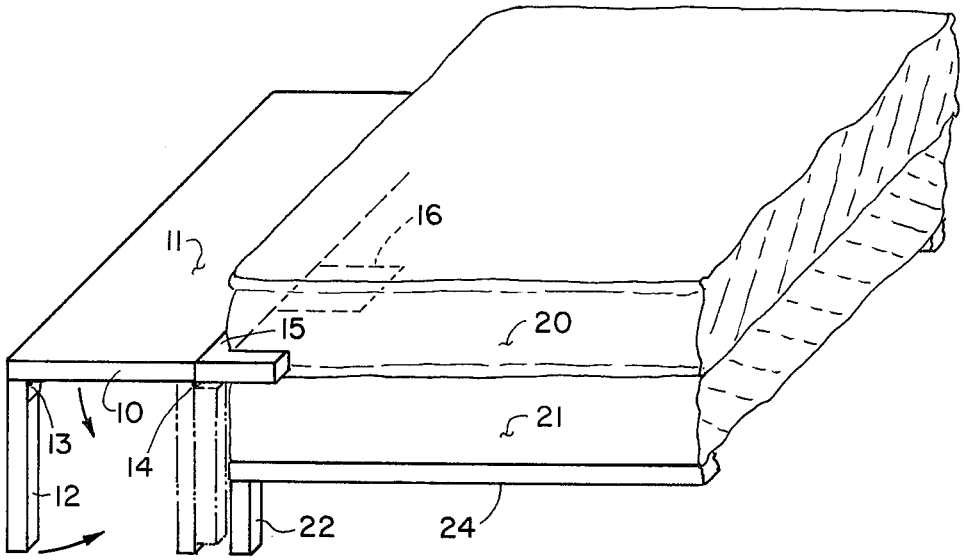
FIG. 1 is a perspective view of the invention attached to a bed.
Figure 2:
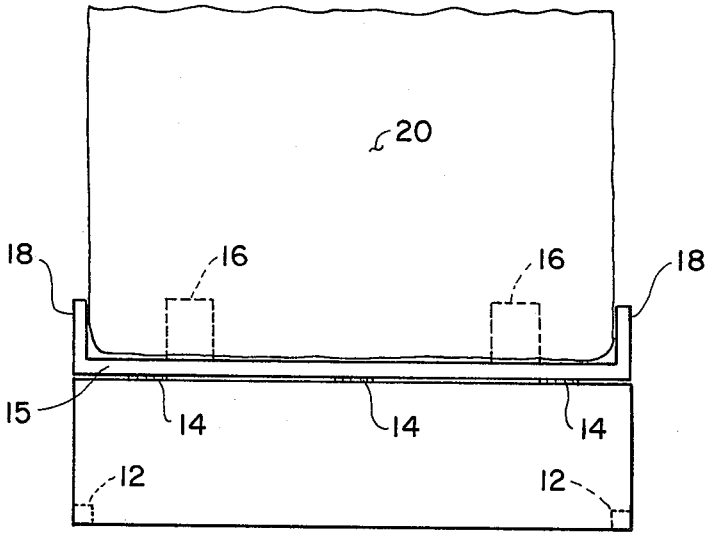
FIG. 2 is a plan view of the invention, in use.

Turning now descriptively to the drawings, in which similar reference characters denote similar elements throughout the several views, FIGS. 1–2 show the invention 10 clamped by the side members 18 of frame 15 to a mattress 20 of a bed. The frame 15 is fitted with braces 16 that fit between the mattress 20 and the mattress spring 21 along the front or the side of a bed.

A platform 11 is fastened by hinges 14 to the frame 15, and legs 12 are fastened by hinges 14 to the underside of platform 11.

As shown by the dash lines in FIG. 1, the platform 11 and legs 12 may be folded to lie in a vertical plane alongside the front or side of the attached bed, in which position the device 10 may be concealed by the side of the bedspread of a made-up bed. When the attached bed is in use, the platform 11 folds out to the horizontal plane and is supported by folding legs 12 to retain the bedspread which has been removed from the bed.

The bed mattress 20 and spring 21 may be supported by horizontal frame members 24 mounted on legs 22 as shown in FIG. 1. Alternately, if the bed is supported by headboards, the frame 15 may be mounted behind the front headboard to the mattress, with the platform 11 folding out underneath the front headboard, between the headboard legs.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desired to secure by Letters Patent of the United States is:

1. A foldable placement platform adaptable for mounting to the mattress and spring support unit of a bed for the support of the bedspread of the bed, when the bedspread has been removed from the bed, said platform hinged to a frame member fitted with attachment means, with folding legs fitted to the underside of the platform, in which the frame member of the device is fitted with means to clamp to the opposed sides of a mattress, and fitted with braces adaptable for fastening between the end of a clamped mattress and the end of the mattress support spring unit, said platform and said frame member joined by hinges which permit the platform to extend in a first position in a horizontal plane away from a mattress to which the frame is clamped, with the platform supported by said hinges and by the attached legs of the platform, and said hinges permitting the platform to be rotated to a second position in a vertical plane, adjacent to the frame and extending from the frame to the floor below the frame, with the legs of the platform folded between the platform and the attached mattress support spring.

* * * * *